US005078034A

United States Patent [19]

Cumino

[11] Patent Number: 5,078,034

[45] Date of Patent: Jan. 7, 1992

[54] CONNECTOR HOUSING SEPARATION MECHANISM

[75] Inventor: Giuseppe Cumino, Rivalta, Italy

[73] Assignee: AMP Incorporated, Harrisburg, Pa.

[21] Appl. No.: 554,618

[22] Filed: Jul. 18, 1990

[30] Foreign Application Priority Data

Jul. 21, 1989 [IT] Italy ..... 21263 A/89

[51] Int. Cl.[5] ..... B26D 7/01

[52] U.S. Cl. ..... 83/453; 83/454; 83/620; 83/697

[58] Field of Search ..... 83/451, 452, 453, 454, 83/455, 697, 622, 620

[56] References Cited

U.S. PATENT DOCUMENTS

| | | | |
|---|---|---|---|
| 4,567,653 | 2/1986 | Heller et al. | 29/874 |
| 4,614,143 | 9/1986 | Ingwerson | 83/622 |
| 4,753,145 | 6/1988 | Bakermans | 83/227 |

FOREIGN PATENT DOCUMENTS

| | | | |
|---|---|---|---|
| 0216465 | 7/1986 | European Pat. Off. | 43/ |
| 1615628 | 7/1967 | Fed. Rep. of Germany | 43/ |

OTHER PUBLICATIONS

European Search Report 90306967.2 dated Oct. 22, 1990.

*Primary Examiner*—Frank T. Yost
*Assistant Examiner*—John M. Husar
*Attorney, Agent, or Firm*—William B. Noll

[57] ABSTRACT

This invention is directed to means (40) for severing multiple, electrical connector housings (10) into single units. The apparatus hereof features a cutting or web severing station (40) comprising one or more horizontally reciprocating cutting bars (30), each said bar (30) at one end thereof having means (32) for mounting same on a pivoting lever arm (46, 52), and at the opposite end (34) a 1) hold-down flange (36) which acts to restrain any vertical movement of said webs, and 2) recessed web severance portion (38). Cooperating with said bar(s) is an essentially "L" shaped lever arm (46) mounted for pivotal action at the junction of the arms thereof, where one arm (48) is mounted for vertical movement by means of a hydraulic piston (50). By virtue of said vertical movement, the remaining lever arm (52), to which such cutting bar (30) is mounted, is caused to reciprocate within a given plane between a web severance position "B" and a remote position "A." An optional feature hereof is the provision of means (86, 88, 90, 92) for vertically adjusting the relative position of the connector housings so as to hold constant the relative position of the connector housing webs (20) to such cutting bar (30).

5 Claims, 3 Drawing Sheets

CONNECTOR HOUSING SEPARATION MECHANISM

BACKGROUND OF THE INVENTION

The present invention relates to electrical connector housings and particularly to apparatus for singulating or separating such housings by severing webs therebetween formed of the housing plastic material for ease of handling and use of such housings.

According to prior practice, a system has evolved relative to electrical connectors of the type employed to make up electrical harnesses for interconnecting circuit components which features the provision of a family of connectors accommodating a variety of discrete harness wires from one to eight or twelve or as many as thirty-two. A "one-way" connector would accommodate a single terminal and wire; a "two-way" connector would accommodate two terminals and wires; an "eight-way," eight and so on, up to thirty-two terminals and wires. Generally, the family of connectors involves providing many different molds for the different sizes of connectors or expandable molds capable of being adjusted to produce numerous one-way connectors with less numerous many-way connectors per mold cycle. Still another approach has been to mold the largest connector of the family and then separate or singulate the molded product into the one-way or two-way or eight-way connectors, as desired. Typically, this latter approach has involved a web or webs joining the connectors and molded of the material of which the connectors are made which web is cut or severed during the separation process. Severing has typically been done by cutting blades, fine saws, shears or knife blades and the like which must be precisely located in conjunction with the precise fixturing of the connector during the separating process. Among the various problems experienced with this process is the fact that jagged edges are left when the web has been severed, which edges are unsatisfactory for a variety of handling and use reasons; the process is slow and expensive and due to the need for precise fixturing, expensive to automate creating additional stations in any automatic equipment with attendant handling and transfer problems.

SUMMARY OF THE INVENTION

Such problems are overcome by the present invention which embraces an apparatus directed at a family of one-way connectors wherein each individual housing is joined to an adjacent housing by a pair of vertically aligned front and back webs and formed of the plastic material of which the connectors are made; such webs being spaced apart and of a geometry to allow unseparated connectors to be handled and used on fixed spacings while at the same time facilitating web removal to provide connectors having between one housing and many housings.

The apparatus of this invention features a cutting or web severing station comprising one or more horizontally reciprocating cutting bars, each said bar at one end thereof having means for mounting same on a pivoting lever arm, and at the opposite end a (1) hold-down flange which acts to restrain any vertical movement of said webs, and (2) recessed web severance portion. Cooperating with said bar(s) is an essentially "L" shaped lever arm mounted for pivotal action at the junction of the arms thereof, where one arm is mounted for vertical movement by means of a hydraulic piston.

By virtue of said vertical movement, the remaining lever arm, to which such cutting bar is mounted, is caused to reciprocate between a web severance position and a remote position.

An optional feature hereof is the provision of means for vertically adjusting the relative position of the connector housings so as to hold constant the relative position of the connector housing webs to such cutting bar.

DETAILED DESCRIPTION OF THE PREFERRED EMBODIMENT

Figure 1:
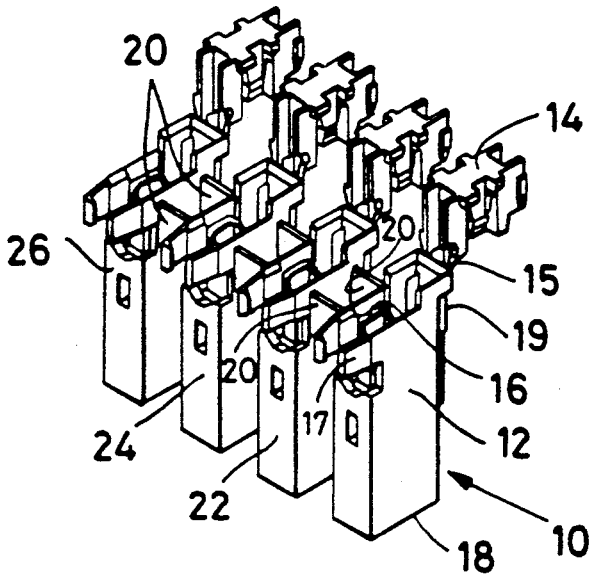
FIG. 1 is a perspective view of a four-way connector housing, with cover, showing each conductor cavity thereof joined by a pair of webs to be severed by the mechanism of this invention.

By way of example, a typical multi-way housing suitable for practicing this invention is illustrated in FIG. 1. Such Figure shows a four-way electrical connector 10 comprised of plastic housings 12, 22, 24 and 26 interconnected by webs 20 formed of the plastic material of which the housings and connector is molded. Each housing such as 12 includes an electrical contact or terminal shown as 16 fitted therewithin. The terminals shown in the connectors may be the insulation displacement contact (IDC) type which allow an insulated wire to be laid in the top of the connector housing and depressed to be terminated to the terminal Each of the housings may include a cover with stuffing element such as 14 shown in respect to housing 12 which is also molded integrally with the housing and hinged as at 15 to be separated therefrom and driven into the top of the housing to stuff the wire within terminal 16 and be latched therewithin by details known in the art. In FIG. 1, latching fingers 17 may be provided for the connector which allow arrays of connectors to be latched together for transport and handling prior to termination, and for strain relief of the wire after termination. The latching fingers 17 of a given row of connectors fit within apertures, such as 19 in an adjacent connector not shown, latching the connector arrays together.

Connectors such as 10 are typically molded of engineering plastics from the nylon family, although other materials having adequate structured and dielectric properties are widely known and used. In practice, connectors such as 10 may be molded in multiples of six or eight or twelve or more. Connectors having simpler details may be molded in arrays having as many as thirty-two individual housings joined together by webs 20 having sufficient structural integrity to allow the multitude of housings to be used as a connector; i.e., a four-way connector being shown in FIG. 1. Alternatively, the array of housings may be singulated or separated into multiples of one, two, three, four, or whatever number is required for a given electrical harness unit by separating housings 12–26.

In accordance with the so-called mass termination techniques employed in production, having the connectors arrayed on fixed centers, as molded, to thus carry the dimensional integrity of molded center spacing greatly facilitates handling and high-speed termination. In order for housings containing multiple cavities to be employed, the web 20 must be appropriately spaced and have sufficient geometrical cross-sections and dimensions to provide structural integrity as between adjacent housings Put another way, the webs are more than mere ties or sprues as between housings. It is indeed this requirement for size and dimension that has made removal of webs 20 challenging.

Figure 2A:
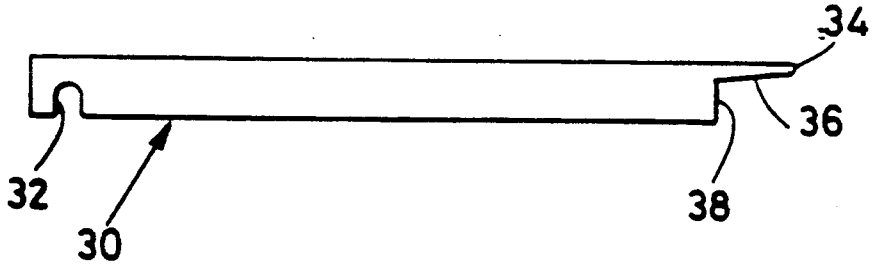
FIGS. 2A and 2B are front and top views, respectively, of a cutting bar suitable for use in practicing this invention.
Figure 2B:
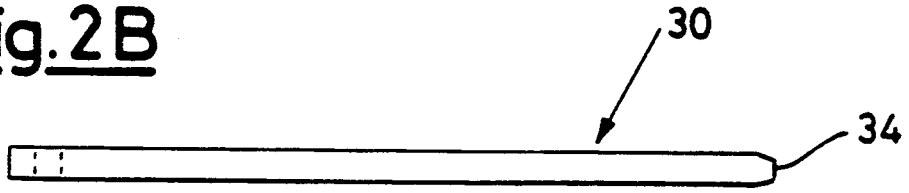

Turning now to the cutting station by which severance of the connector housing is achieved, FIGS. 2A and 2B illustrate a preferred embodiment for a cutting bar 30, typically fabricated from alloy steel. At one end thereof, slotted means 32 is provided for mounting on a lever arm, hereinafter described. The opposite end 34 is provided with a tapered top 36 below which are the web cutting edges 38. As will become apparent by the description which follows, the tapered top 36 is adapted to override and exert pressure on the webs 20 to stabilize the housings for subsequent severance of the webs 20. Finally, the width of cutting bar 30 is such as to slide between adjacent housings so as to facilitate severance of the webs 20 at their junction with the housing side walls, that is, flush with such side walls.

Figure 3:
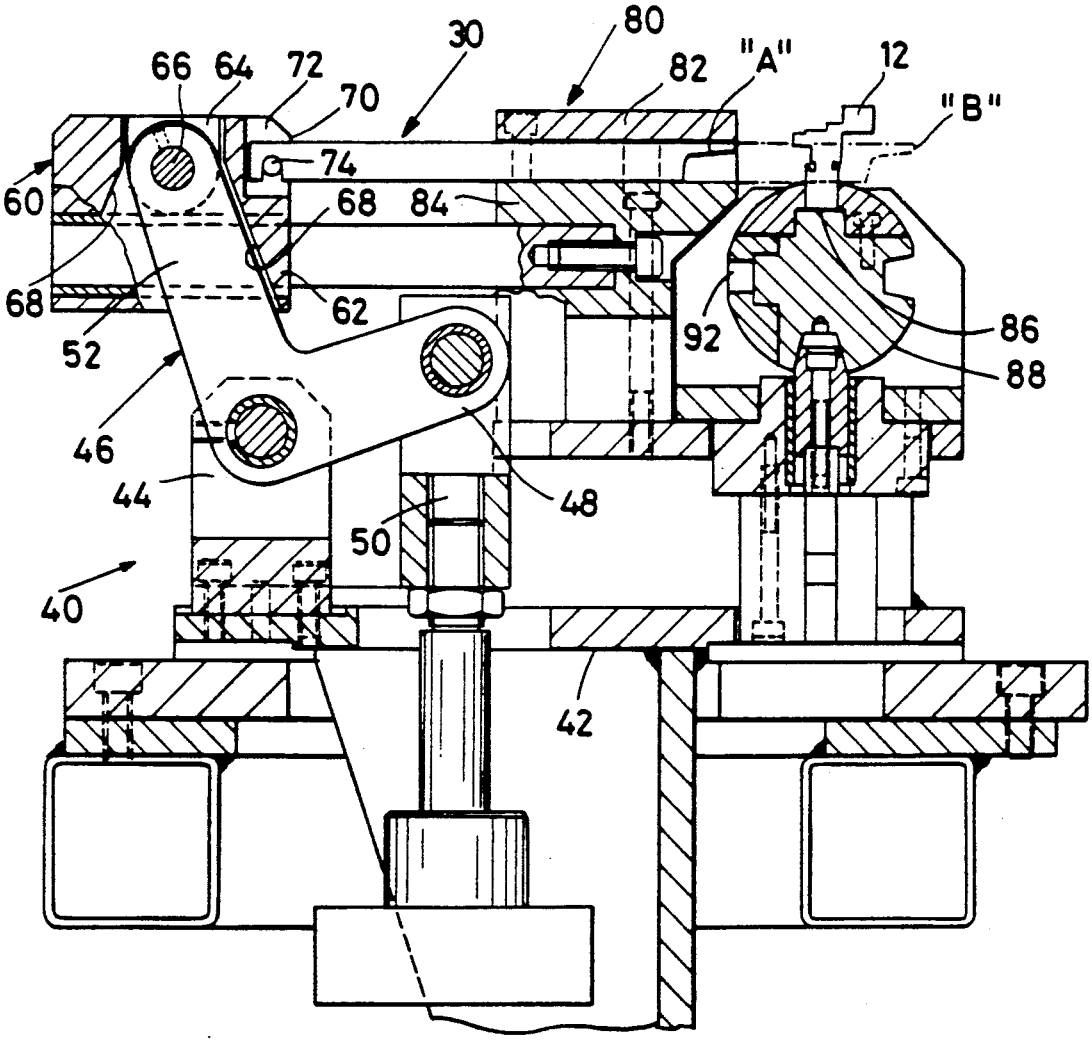
FIG. 3 is a front view of the cutting station featuring the cutting mechanism according to this invention.
Figure 4:
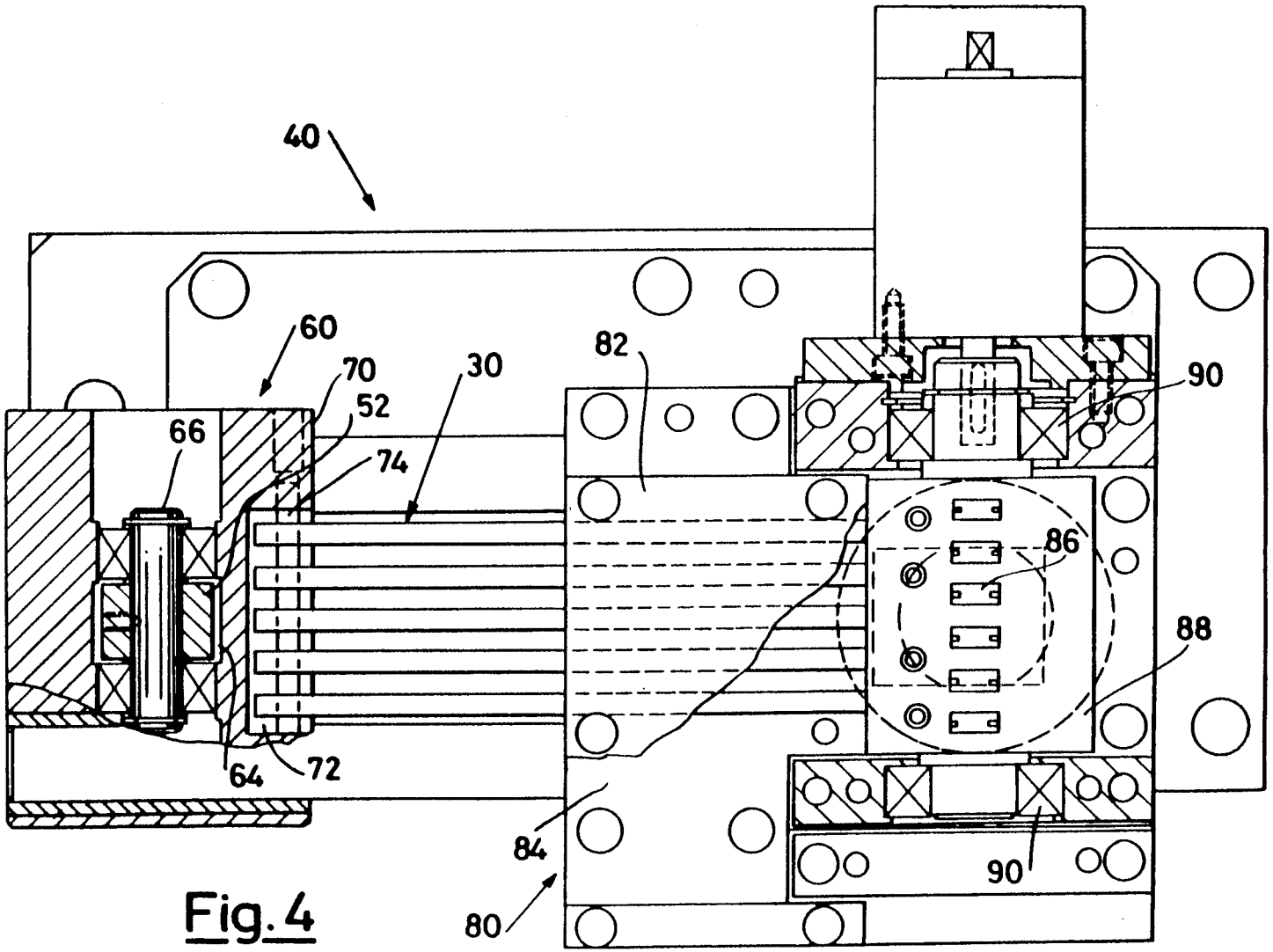
FIG. 4 is an enlarged top view of the mechanism illustrated in FIG. 3.

FIGS. 3 and 4 illustrate the preferred manner by which the cutting bars 30 may by employed to effect severance of the housing webs 20. The preferred cutting station 40, as illustrated thereby, comprises a housing support 42 for mounting the various components thereof. Fixed thereto is a vertical arm 44 upon which is mounted an "L" shaped lever arm 46 for limited pivotal motion. A first arm 48 of lever arm 44 is mounted for vertical movement through the action of cylinder or piston 50. By such action, the second arm 52 is caused to move in an essentially horizontal direction, i.e. from a web cutting position to a remote position spaced from the connector housing.

The cutting bar support 60 comprises a housing 62 having a through cavity 64 therein within which is journaled pivotal bar 66. The through cavity 64 has downwardly directed diverging side walls 68 which define the pivotal limits for the second lever arm 52 mounted on pivot bar 66. At the forward end 70 of bar support 60, a recess 72 is provided. Within such recess 72, a laterally disposed bar 74 is mounted. One or more cutting bars 30 are arranged therealong in parallel fashion. As the cutting bar support 60 pivots, such cutting bars 30 are caused to move horizontally from a remote position (identified as "A") to a post-cutting position (identified as "B"), both such positions illustrated in FIG. 3. To facilitate the movement of cutting bars 30 from position "A" to position "B," bar guide 80 is provided to override such bars. Bar guide 80 consists of spaced apart upper plate 82 and lower plate 84, with appropriate channels or slots therebetween to guide bars 30 from "A" to "B", and return.

Since a preferred feature hereof is the provision of the cutting bars 30 movable in a fixed plane, means are provided to allow for different housing sizes. Such means are illustrated best at the right side of FIG. 3. A typical housing 12 is shown seated in a recess 86 in a rotating support 88, arranged for rotation in journals 90 (FIG. 4). Returning to FIG. 3, a second recess 92 disposed 90° from recess 86 and having a different depth is illustrated. By the use of plural recesses of different depths, it will be appreciated that a like plurality of different housings may be processed thereby in a manner to position the webs 20 in the plane of the cutting bars 30.

I claim:

1. Apparatus for the separation of plural electrical connector housings into singular units, where adjacent such units are joined by webs integrally molded with said housings, characterized by a web severing station, said station comprising:

a. one or more horizontally reciprocating cutting bars, having means on one end thereof to effect such reciprocating action, cutting means at the opposite end to effect severance of said webs, and a hold-down flange adapted to override a corresponding web prior to the severance thereof;

b. a lever arm mounted for pivotal action to cause the horizontal movement of said cutting bars;

c. means to confine the movement of said cutting bars within a predefined plane; and d. means for securing said housings so as to present the webs thereof to severance within such plane.

2. The apparatus according to claim 1 wherein said lever arm is "L" shaped such that the vertical movement of one leg thereof causes a horizontal movement of the other leg.

3. The apparatus according to claim 1 wherein means are provided for adjusting the relative position of said housings to expose said webs to said cutting bars within said predefined plane.

4. The apparatus according to claim 3 wherein said last identified means includes a fixed guide member which overrides said cutting bars.

5. The apparatus according to claim 3 wherein said means for securing said housings comprises an intermittent rotational member having plural stations thereabout for receiving said housings.

* * * * *